US008079338B2

(12) United States Patent
Schwoerer et al.

(10) Patent No.: US 8,079,338 B2
(45) Date of Patent: Dec. 20, 2011

(54) SELF ADJUSTING VALVE CATCH WITH VALVE SEATING CONTROL

(75) Inventors: John A. Schwoerer, Storrs, CT (US); Zhou Yang, Oak Ridge, NC (US); Ryan C. Noss, State College, PA (US); Brian L. Ruggiero, East Granby, CT (US); Neil E. Fuchs, New Hartford, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 578 days.

(21) Appl. No.: 12/233,312

(22) Filed: Sep. 18, 2008

(65) Prior Publication Data

US 2009/0184273 A1 Jul. 23, 2009

Related U.S. Application Data

(63) Continuation-in-part of application No. 11/401,260, filed on Apr. 11, 2006.

(51) Int. Cl.
*F01L 1/14* (2006.01)

(52) U.S. Cl. ..... 123/90.48; 123/90.12; 123/90.16

(58) Field of Classification Search ..... 123/90.48, 123/90.12, 90.16, 90.41
See application file for complete search history.

(56) References Cited

U.S. PATENT DOCUMENTS 5,381,772 A * 1/1995 Melchior et al. ..... 123/447
6,192,841 B1 2/2001 Vorih et al.
6,510,824 B2 1/2003 Vorih et al.
6,637,387 B1 10/2003 Gecim et al.
2005/0229888 A1 10/2005 Vanderpoel
2006/0273271 A1 12/2006 Yang et al.

OTHER PUBLICATIONS

Hope A. Bolton and Jay M. Larson, Valvetrain System Design and Materials, "A Chronology of Hydraulic Lash Compensation in the United States" by W.A. Dammers (Eaton Corporation, Marshall, Michigan), International Symposium on Valvetrain System Design and Materials, Apr. 14-15, 1997, pp. 27-41, ASM International, Materials Park, Ohio, United States of America.

* cited by examiner

*Primary Examiner* — Zelalem Eshete
(74) *Attorney, Agent, or Firm* — David R. Yohannan; Kelley Drye & Warren LLP

(57) ABSTRACT

A variable valve actuation system to actuate and control the seating velocity of an internal combustion engine valve is disclosed. The system comprises: a housing having a bore formed therein; an outer piston slidably disposed in the bore, said outer piston having an internal hydraulic passage, an internal chamber defined by an outer piston side wall, and an internal orifice connecting the internal hydraulic passage and the internal chamber; a catch piston slidably disposed in the outer piston; and a cone-shaped extension extending from the inner piston, wherein the cone-shaped extension is adapted to provide a variable flow area through the outer piston orifice to provide improved engine valve seating.

12 Claims, 7 Drawing Sheets

SELF ADJUSTING VALVE CATCH WITH VALVE SEATING CONTROL

CROSS-REFERENCE TO RELATED APPLICATIONS

The present application is a continuation in part of, relates to, and claims the benefit of the priority date of earlier filed U.S. patent application Ser. No. 11/401,260 which was filed Apr. 11, 2006 and entitled "Valve Actuation System With Valve Seating Control" and which is incorporated herein by reference.

FIELD OF THE INVENTION

The present invention relates generally to systems and methods for controlling internal combustion engine valves. In particular, the present invention relates to systems and methods for controlled seating of engine valves.

BACKGROUND OF THE INVENTION

Engine combustion chamber valves, such as intake and exhaust valves, are typically spring biased toward a valve closed position. In many internal combustion engines, the engine valves may be opened and closed by fixed profile cams in the engine. More specifically, valves may be opened or closed by one or more fixed lobes on the cams. In some cases, the use of fixed profile cams may make it difficult to adjust the timings and/or amounts of engine valve lift. It may be desirable, however, to adjust valve opening and closing times and lift for various engine operating conditions, such as different engine speeds.

A method of adjusting valve timing and lift, given a fixed cam profile, has been to incorporate a "lost motion" device in the valve train linkage between the valve and the cam. Lost motion is the term applied to a class of technical solutions for modifying the valve motion dictated by a cam profile with a variable length mechanical, hydraulic, or other linkage means. The lost motion system may comprise a variable length device included in the valve train linkage between the cam and the engine valve. The lobe(s) on the cam may provide the "maximum" (longest dwell and greatest lift) motion needed for a range of engine operating conditions. When expanded fully, the variable length device (or lost motion system) may transmit all of the cam motion to the valve, and when contracted fully, transmit none or a reduced amount of cam motion to the valve. By selectively decreasing the length of the lost motion system, part or all of the motion imparted by the cam to the valve can be effectively subtracted or lost.

Hydraulic-based lost motion systems may provide a variable length device through use of a hydraulically extendable and retractable piston assembly. The length of the device is shortened when the piston is retracted into its hydraulic chamber, and the length of the device is increased when the piston is extended out of the hydraulic chamber. One or more hydraulic fluid control valves may be used to control the flow of hydraulic fluid into and out of the hydraulic chamber.

One type of lost motion system, known as a Variable Valve Actuation (VVA) system, may provide multiple levels of lost motion. Hydraulic VVA systems may employ a high-speed control valve to rapidly change the amount of hydraulic fluid in the chamber housing the hydraulic lost motion piston. The control valve may also be capable of providing more than two levels of hydraulic fluid in the chamber, thereby allowing the lost motion system to attain multiple lengths and provide variable levels of valve actuation.

Typically, engine valves are required to open and close very quickly, and therefore the valve return springs are generally relatively stiff. If left unchecked after a valve opening event, the valve return spring could cause the valve to impact its seat with sufficient force to cause damage to the valve and/or its seat. In valve actuation systems that use a valve lifter to follow a cam profile, the cam profile provides built-in valve closing velocity control. The cam profile may be formed so that the actuation lobe merges gently with cam base circle, which acts to decelerate the engine valve as it approaches its seat.

In hydraulic lost motion systems, and in particular VVA hydraulic lost motion systems, rapid draining of fluid from the hydraulic circuit may prevent the valve from experiencing the valve seating provided by the cam profile. In VVA systems, for example, an engine valve may be closed at an earlier time than that provided by the cam profile by rapidly releasing hydraulic fluid from the lost motion system. When fluid is released from the lost motion system, the valve return spring may cause the engine valve to "free fall" and impact the valve seat at an unacceptably high velocity. The valve may impact the valve seat with such force that it eventually erodes the valve or valve seat, or even cracks or breaks the valve. In such instances, engine valve seating control may be desired because the closing velocity of the valve is governed by the release of hydraulic fluid from the lost motion system instead of by a fixed cam profile. Accordingly, there is a need for valve seating devices in engines that include lost motion systems, and most notably in VVA lost motion systems.

In order to avoid a damaging impact between the engine valve and its seat, the valve seating device may oppose the closing motion regardless of the position of other valve train elements. In order to achieve this goal, the point at which the engine valve experiences valve seating control may be relatively constant. In other words, the point during the travel of the engine valve at which the valve seating device actively opposes the closing motion of the valve should be relatively constant for all engine operating conditions. Accordingly, it may be advantageous to position the valve seating device such that it can oppose the closing motion of the engine valve without regard to the position of intervening valve train elements, such as rocker arms, push tubes, or the like.

The valve seating device may include hydraulic elements, and thus may need to be supported in a housing and require a supply of hydraulic fluid, yet at the same time fit within the packaging limits of a particular engine. It may also be advantageous to locate the valve seating device near other hydraulic lost motion components. By locating the valve seating device near other lost motion components, housings, hydraulic feeds, and/or accumulators may be shared, thereby reducing bulk and the number of required components.

Various embodiments of the present invention may meet one or more of the aforementioned needs and provide other benefits as well.

SUMMARY OF THE INVENTION

Applicant has developed an innovative valve actuation system having valve seating control. In one embodiment, the system comprises a housing having a bore, a bore side wall, and side wall openings; an outer piston slidably disposed in the bore, the outer piston having an internal hydraulic passage, an internal chamber defined by an outer piston side wall, and an internal orifice connecting the internal hydraulic passage and the internal chamber; and a catch piston slidably disposed in the outer piston, the catch piston having a cone-shaped extension extending from the catch piston into the outer piston orifice.

Applicant has still further developed an innovative valve seating device, comprising: a housing having a bore, a bore side wall, and side wall openings; an outer piston slidably disposed in the bore, the outer piston having an internal hydraulic passage, an internal chamber defined by an outer piston side wall, and an internal orifice connecting the internal hydraulic passage and the internal chamber; a catch piston slidably disposed in the outer piston, the catch piston having a cone-shaped extension extending from the catch piston into the outer piston orifice, and the catch piston having a hollow interior portion; a cap disposed at an upper portion of the outer piston; and a catch piston spring disposed between the outer piston and the cap.

Applicant has still further developed an innovative valve seating device, comprising: a housing having a bore, a bore side wall, and side wall openings; an outer piston slidably disposed in the bore, the outer piston having an internal hydraulic passage, an internal chamber defined by an outer piston side wall, and an internal orifice connecting the internal hydraulic passage and the internal chamber; a cylindrically shaped catch piston slidably disposed in the outer piston, the catch piston having a hollow interior portion; a cap disposed at an upper portion of the outer piston; and a catch piston spring disposed between the outer piston and the cap.

Applicant has further developed an innovative valve seating device, comprising: a housing having a bore formed therein; an outer piston slidably disposed in the bore, the outer piston having an orifice formed therein; and a catch piston slidably disposed in the outer piston, said catch piston having a cone-shaped extension extending from the catch piston into the outer piston orifice.

Applicant has further developed an innovative valve seating device, comprising: a housing having a bore formed therein; a cylindrically-shaped outer piston slidably disposed in the bore, the outer piston having an orifice formed in a lower portion thereof and having a hollow interior portion; a cylindrically-shaped catch piston slidably disposed in the outer piston, said catch piston having a cone-shaped extension extending from the catch piston into the outer piston orifice, and having a hollow interior portion; a cap disposed at an upper portion of the outer piston, said cap having an opening therein; a catch spring disposed between the catch piston and the cap; and at least one spring disposed between the cap and an end wall of the housing bore.

Applicant has further developed an innovative valve seating device, comprising: a housing having a bore formed therein; a cylindrically-shaped outer piston slidably disposed in the bore, the outer piston having an orifice formed in a lower portion thereof and having a hollow interior portion; a cylindrically-shaped catch piston slidably disposed in the outer piston, said catch piston having a cone-shaped extension extending from the catch piston into the outer piston orifice, and having a hollow interior portion; a cap disposed at an upper portion of the outer piston, said cap having an opening therein; a catch spring disposed between the catch piston and the cap; at least one spring disposed between the cap and an end wall of the housing bore; and one or more check valves disposed between the outer piston and a lower portion of the housing bore.

It is to be understood that both the foregoing general description and the following detailed description are exemplary and explanatory only, and are not restrictive of the invention as claimed. The accompanying drawings, which are incorporated herein by reference, and which constitute a part of specification, illustrate certain embodiments of the invention and, together with the detailed description, serve to explain the principles of the present invention.

BRIEF DESCRIPTION OF THE DRAWINGS

In order to assist in the understanding of the invention, reference will now be made to the appended drawings, in which like reference characters refer to like elements. The drawings are exemplary only, and should not be construed as limiting the invention.

DETAILED DESCRIPTION OF PREFERRED EMBODIMENTS OF THE INVENTION

Figure 1:
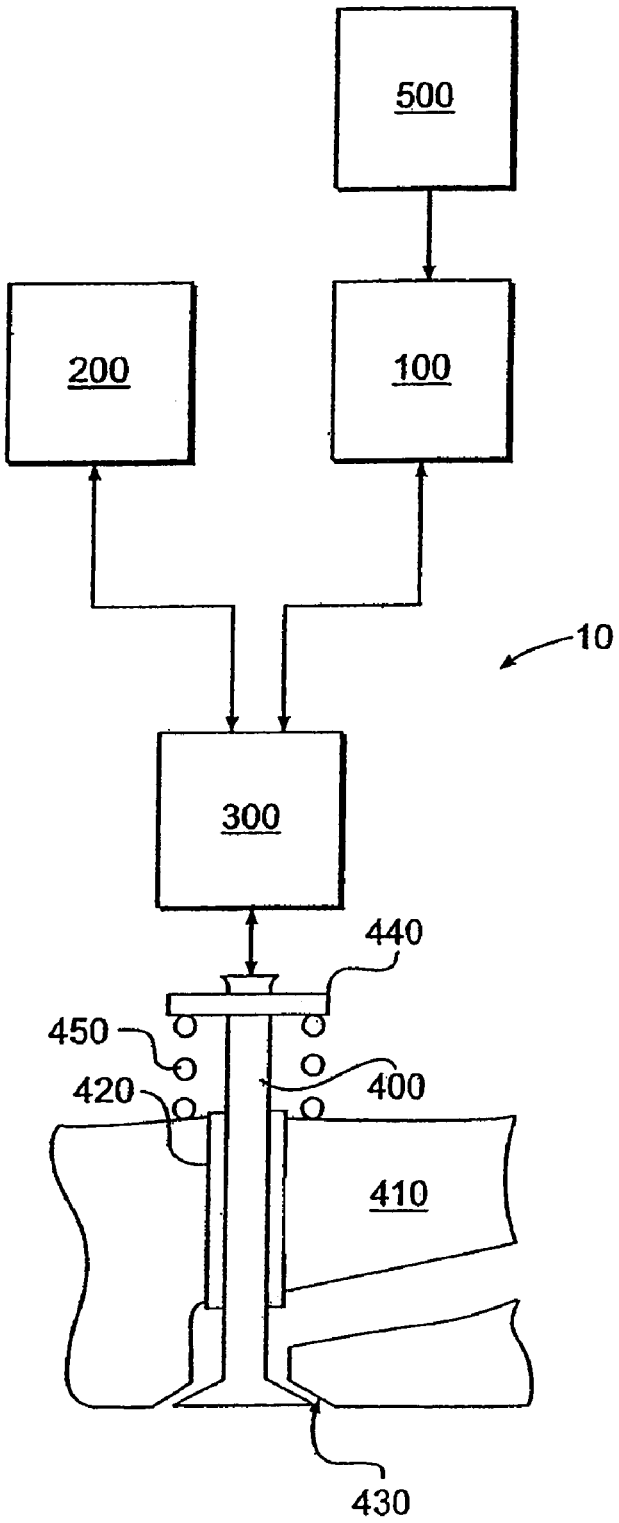
FIG. 1 is a schematic diagram of a valve seating control system.

Reference will now be made in detail to a first embodiment of a valve seating control system 10 of the present invention, an example of which is illustrated in FIG. 1. The system 10 may include one or more valve train elements 300 operatively connected to a lost motion system 100, a valve seating device 200, and at least one engine valve 400. The lost motion system 100 may receive an input from a motion imparting means 500. The valve train element 300 may transmit a valve actuation motion to the engine valve 400. The engine valve 400 may be actuated to produce various engine valve events, such as, but not limited to, main intake, main exhaust, compression release braking, bleeder braking, exhaust gas recirculation, early exhaust valve opening and/or closing, early intake opening and/or closing, centered lift, etc. The engine valve 400 may comprise an exhaust valve, intake valve, or auxiliary valve.

The motion imparting means 500 may comprise any combination of cam(s), push-tube(s), rocker arm(s) or other mechanical, electro-mechanical, hydraulic, or pneumatic device for imparting a linear actuation motion. The motion imparting means 500 may receive motion from an engine component and transfer the motion as an input to the lost motion system 100.

The lost motion system 100 may comprise any structure that connects the motion imparting means 500 to the valve train element 300 and which is capable of selectively losing part or all of the motion imparted to it by the motion imparting means 500. The lost motion system 100 may comprise, for example, a variable length mechanical linkage, hydraulic circuit, hydro-mechanical linkage, electro-mechanical linkage, and/or any other linkage provided between the motion imparting means 500 and the valve train element 300 and adapted to attain more than one operative length. If the lost motion system 100 incorporates a hydraulic circuit, it may include means for adjusting the pressure or the amount of fluid in the hydraulic circuit, such as, for example, trigger valve(s), check valve(s), accumulator(s), and/or other devices used to release hydraulic fluid from, or add hydraulic fluid to, a hydraulic circuit.

The engine valve 400 may be disposed within a sleeve 420, which in turn is provided in a cylinder head 410. The engine valve 400 may be adapted to slide up and down relative to the sleeve 420 and may be biased into a closed position by a valve spring 450. The valve spring 450 may be compressed between the cylinder head 410 and a valve spring retainer 440 that may be attached to the end of a valve stem, thereby biasing the engine valve 400 into an engine valve seat 430. When the engine valve 400 is in contact with the engine valve seat 430, the engine valve 400 is effectively in a closed position.

The one or more valve train elements 300 may receive a force from the lost motion system 100 and may transfer this force to the engine valve 400. The one or more valve train elements 300 may also transmit the force of the valve spring 450 that biases the engine valve 400 into a closed position back to the lost motion system 100 and/or the valve seating device 200.

The valve seating device 200 may be operatively connected to the valve train element 300. When the valve seating device 200 is activated, it may provide a resistance to the bias of the engine valve spring 450 through the valve train element 300. In a preferred embodiment, the valve seating device 200 may be constantly activated. It is contemplated, however, that the valve seating device 200 may be deactivated when a user desires, so that it does not operate to seat the engine valve 400 at selected times. When the valve seating device 200 is deactivated, the engine valve 400 may seat under the bias of the engine valve spring 450 and/or the lost motion device 100.

When the lost motion system 100 is not activated to lose motion, motion may be transferred from the motion imparting means 500 to the engine valve 400 through the valve train element 300. Likewise, the force of the engine valve spring 450 may be transferred from the engine valve spring 450, through the valve train element 300, and to the lost motion system 100 and/or the valve seating device 200. However, when the lost motion system 100 acts to lose the motion of the motion imparting means 500, the engine valve 400 normally may close in "free-fall," a state in which the engine valve 400 may contact the engine valve seat 430 at an undesirably high rate of speed. In order to slow the velocity at which the engine valve 400 closes when the lost motion system 100 is losing motion, the valve seating device 200 may be used.

The valve seating device 200 may slow the speed at which the engine valve 400 contacts the engine valve seat 430 by opposing the motion of the engine valve 400 through the valve train element 300. The valve seating device 200 may slow the seating velocity of the engine valve 400, preferably in a progressive manner, and particularly in the last millimeter of travel, thereby reducing the wear and damage on both the engine valve 400 and the engine valve seat 430.

Examples of the use of known valve seating devices are disclosed in U.S. Pat. Nos. 6,474,277 Vanderpoel et al. and 6,302,370 Schwoerer et al., each of which is hereby incorporated by reference.

Figure 2:
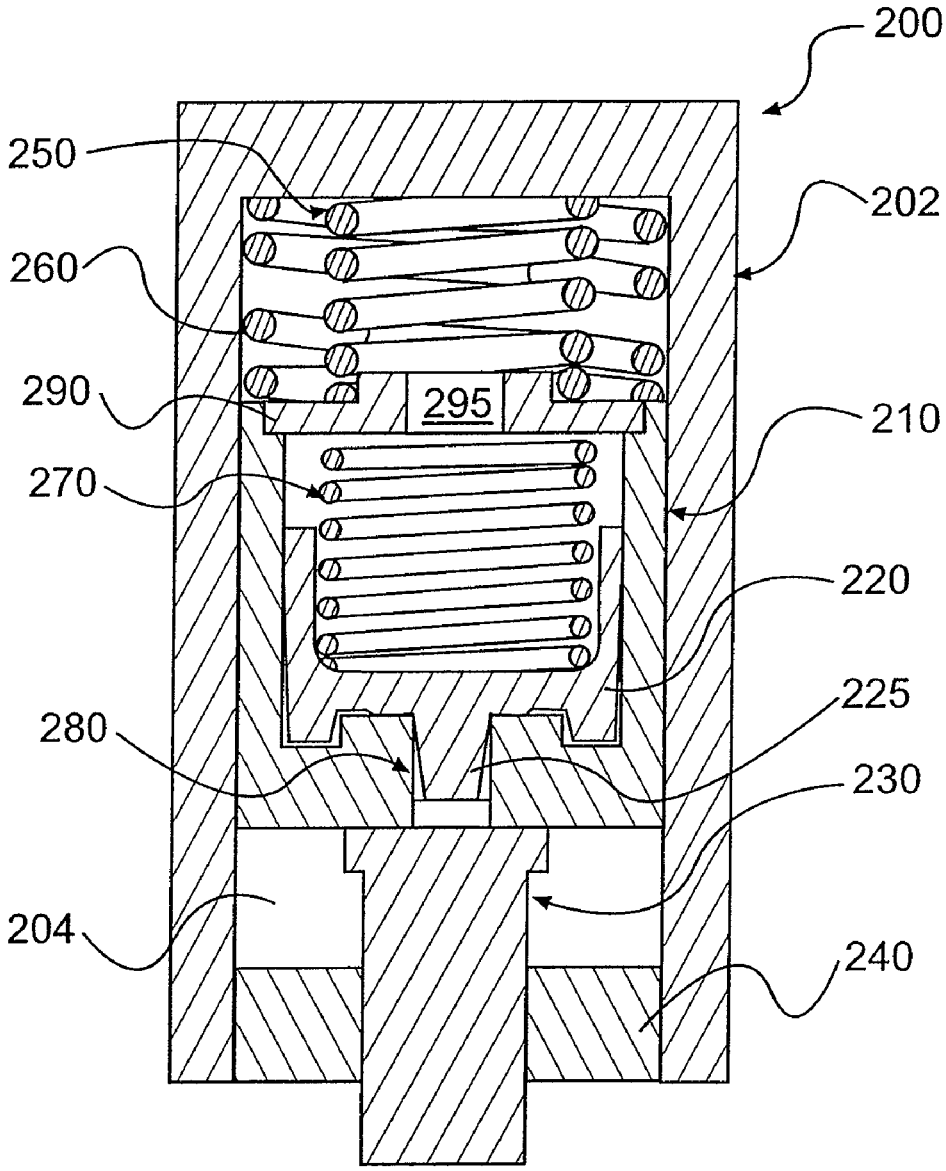
FIG. 2 is a cross-sectional view of a valve seating device in accordance with a first embodiment of the present invention.

A first embodiment of the valve seating device 200 is illustrated in detail in FIG. 2, in which like reference characters refer to like elements. The valve seating device 200 may be disposed in a housing 202 having a cylindrical bore formed therein. A lower housing portion 204 may include one or more ports (not shown) for supplying hydraulic fluid to the valve seating device.

A cylindrically shaped outer piston 210 may be slidably disposed in the housing 202. The outer piston 210 may include a hollow interior portion, an orifice 280 in a lower portion, and an upper end. The orifice 280 may permit hydraulic fluid to flow between the hollow interior portion of the outer piston 210 and the lower portion 204 of the housing 202. The outer piston 210 may also include a ring-shaped indentation formed in its lower interior portion.

A cylindrically shaped catch piston 220 may be slidably disposed in the hollow interior portion of the outer piston 210. The catch piston 220 may include a cone-shaped extension 225 which extends from the bottom of the catch piston into the orifice 280 when the catch piston 220 is resting against the outer piston 210. The catch piston 220 may also include a hollow interior portion. An outer annular ring may also extend from the lower portion of the catch piston into the ring-shaped indentation in the outer piston 210.

The cone-shaped extension 225 of the catch piston 220 may be selectively shaped to taper from its base to its lower terminus. The taper of the cone-shaped extension 225 may be selected to have substantially the same diameter of the orifice 280 at its base and a smaller diameter at its lower terminus. The cone-shaped extension 225 may taper linearly, progressively, or less than linearly from base to terminus depending upon the desired level of throttling of the flow of fluid through the orifice 280 during valve seating events.

A cap 290 may be provided at the upper end of the outer piston 210. The cap may include a cap opening 295 which permits hydraulic fluid flow between the interior portion of the outer piston 210 and the upper portion of the housing bore in which the outer piston is slidably disposed. A catch piston spring 270 may be disposed in the interior portions of the outer piston 210 and the catch piston 220. The catch piston spring 270 may bias the catch piston 220 and the cap 290 away from each other. An inner cap spring 250 and an outer cap spring 260 may be disposed in the upper portion of the bore in the housing 202. The inner cap spring 250 and the outer cap spring 260 may bias the cap 290 and outer piston 210 away from the upper end wall of the housing 202 bore.

A slidable pin 230 may be disposed in the lower housing portion 204. The slidable pin 230 may be maintained in a central location relative to the orifice 280 by a pin guide 240. The pin guide 240 may permit the pin 230 to slide vertically so that it may selectively cover the orifice 280. As shown in FIG. 1, the pin 230 may include a lower end which contacts an engine valve 400, or an engine valve bridge or any one of a number of intervening valve train elements 300 which contact the engine valve. The pin 230 permits transfer of engine valve closing force and valve seating resistance between the engine valve 400 and the valve seating device 200. The inner cap spring 250, outer cap spring 260, and the catch piston spring 270 may collectively bias the valve seating device 200 against the pin 230, which in turn may be biased against the engine valve.

The valve seating device 200 may operate as follows. When valve seating control is desired, hydraulic fluid may be provided to the lower housing portion 204 through an automated control valve or otherwise. When the engine valve opens, the pin 230 may follow the engine valve downward. As the pin 230 translates downward, the inner and outer cap springs 250 and 260, and the catch piston spring 270, may cause the elements of the valve seating device 200 to separate. Eventually, the orifice 280 may no longer be covered by the upper end of the pin 230. Because the downward bias of the catch piston spring 270 is not great enough, and/or because the spring reaches its maximum extension, the hydraulic fluid in the lower housing portion 204 may push the catch piston 220 upward and the hydraulic fluid may flow past the cone-shaped extension 225 to fill the space between the outer piston 210 and the catch piston 220. Hydraulic fluid may also leak past the space between the catch piston 220 and the outer piston 210 to fill the interior portions of the catch piston and the outer piston, as well as the space above the cap 290. As a result all interior spaces of the valve seating device 200 may be filled with hydraulic fluid.

As the engine valve closes, the pin 230 translates upward until it meets the outer piston 210. When the pin 230 meets the outer piston, it may completely or partially cover the lower end of the orifice 280 and thus may at least partially block fluid flow from the space between the outer piston 210 and the catch piston 220 to the lower housing portion 204. Further upward translation of the pin 230 may be resisted by the springs 250, 260 and 270, as well as by the hydraulic fluid in the valve seating device 200. The cone-shaped extension 225 may progressively throttle fluid flow out of the space between the outer piston 210 and the catch piston 220. The progressive throttling of the fluid flow permits the resistance to the upward translation of the pin 230 to progressively increase as the engine valve approaches its seat, thereby progressively reducing the upward velocity of the engine valve until it is seated. The cone-shaped extension 225 may be designed to progressively throttle this fluid flow during the last millimeter of engine valve travel before it is seated. In this manner, the cone-shaped extension provides a variable flow area through the orifice 280. This may also permit the orifice 280 to have a greater diameter and may provide more rapid refill of the interior of the valve seating device 200 with hydraulic fluid for the next valve seating event. Hydraulic fluid that flows from the interior of the valve seating device 200 back into the lower housing portion 204 may be absorbed into the relatively low pressure hydraulic fluid supply system (not shown) which provides the lower housing portion with fluid.

Figure 3:
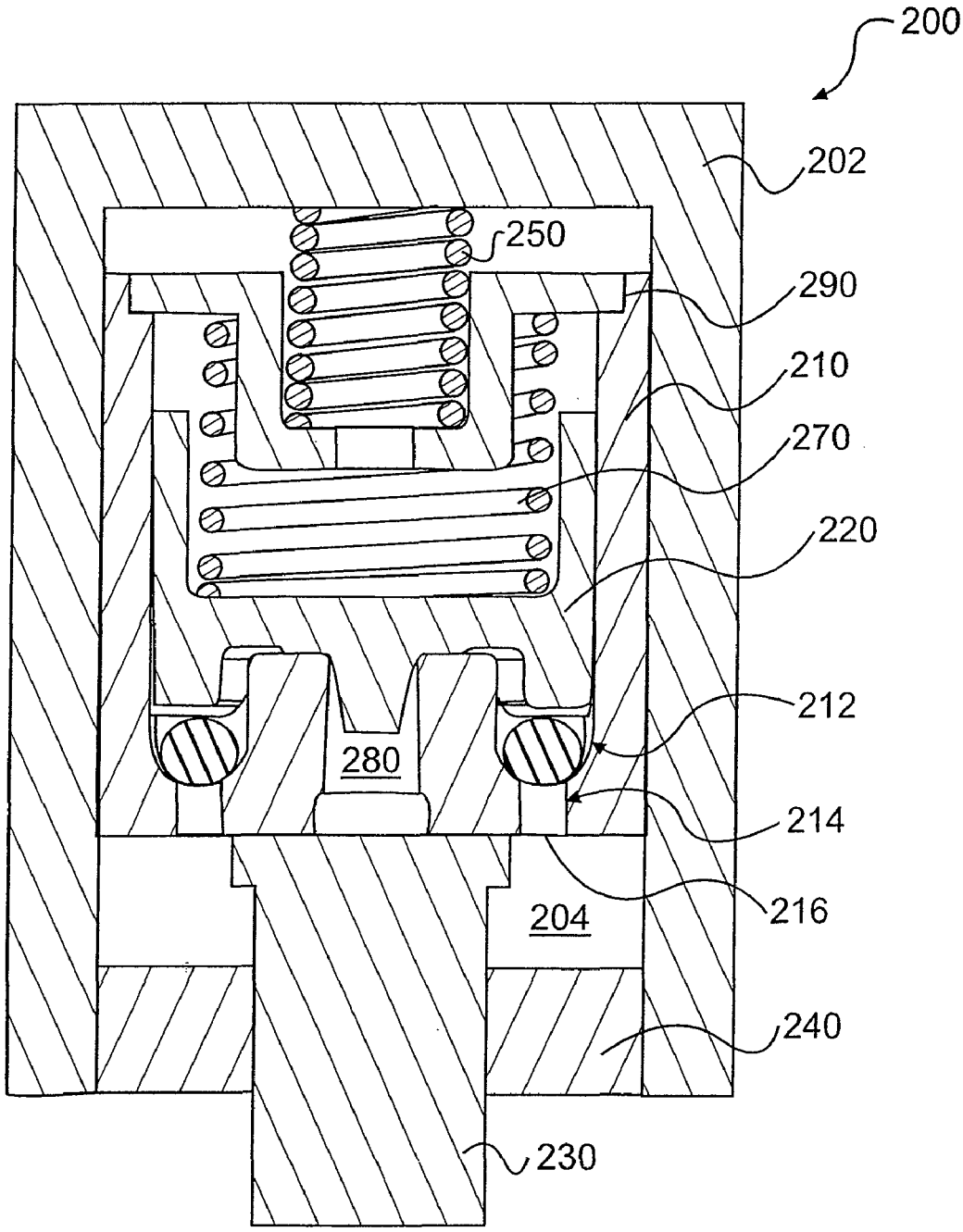
FIG. 3 is a cross-sectional view of a valve seating device in accordance with a second embodiment of the present invention.

A second embodiment of the valve seating device 200 is illustrated in FIG. 3, in which like reference characters refer to like elements. The valve seating device shown in FIG. 3 differs from that shown in FIG. 2 in that it includes one or more check valves provided between the outer piston 210 and the lower housing portion 204. Each check valve may comprise a check ball 212 which may rest on a check seat 214 at the upper end of a check passage 216. The check valves permit one-way fluid flow from the lower housing portion 204 to the space between the outer piston 210 and the catch piston 220. The check valves may permit more rapid refill of the valve seating device 200 with hydraulic fluid between valve seating events.

Figure 5:
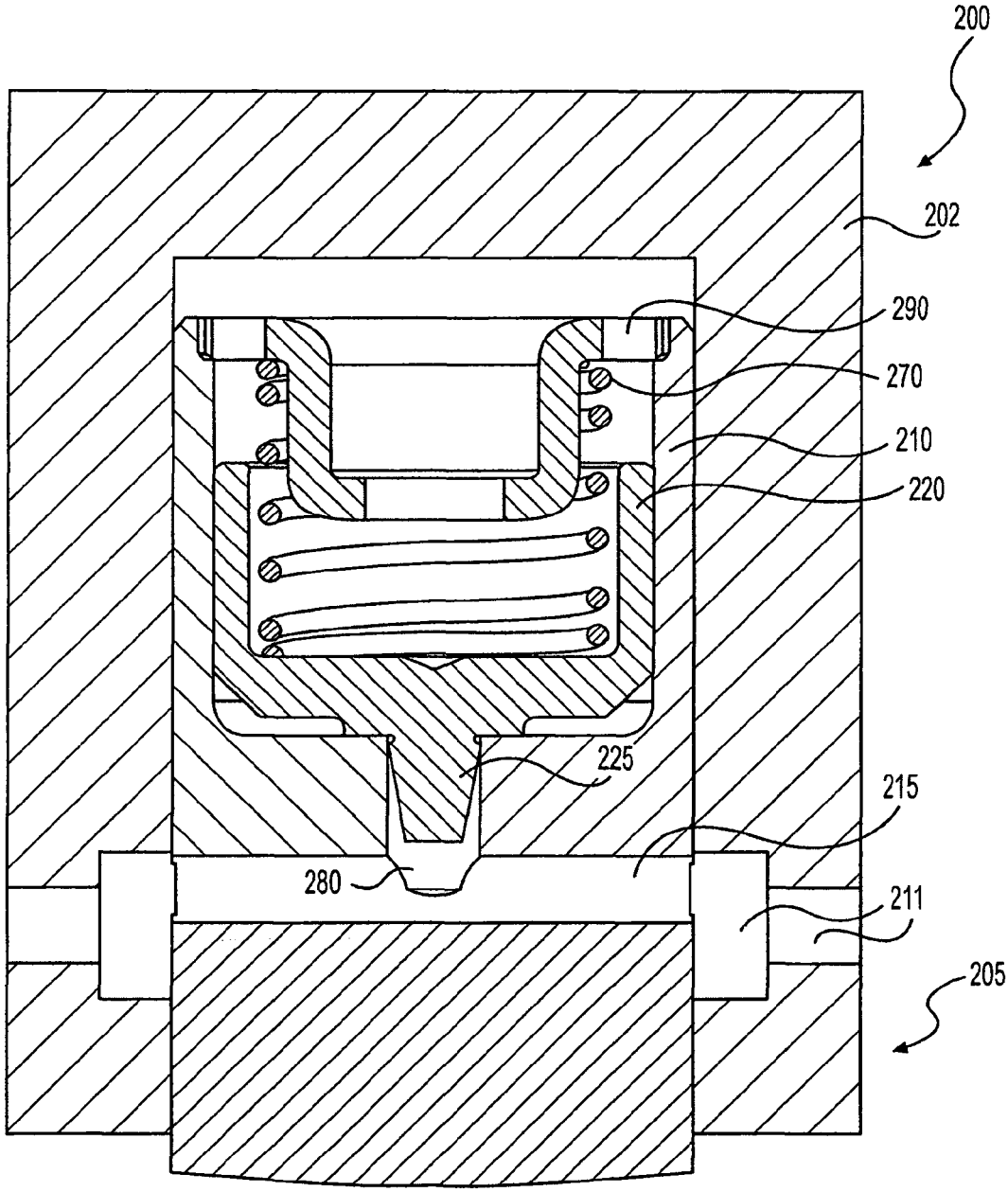
FIG. 5 is a cross-sectional view of a valve seating device in accordance with a third embodiment of the present invention during a first valve seating position.
Figure 6:
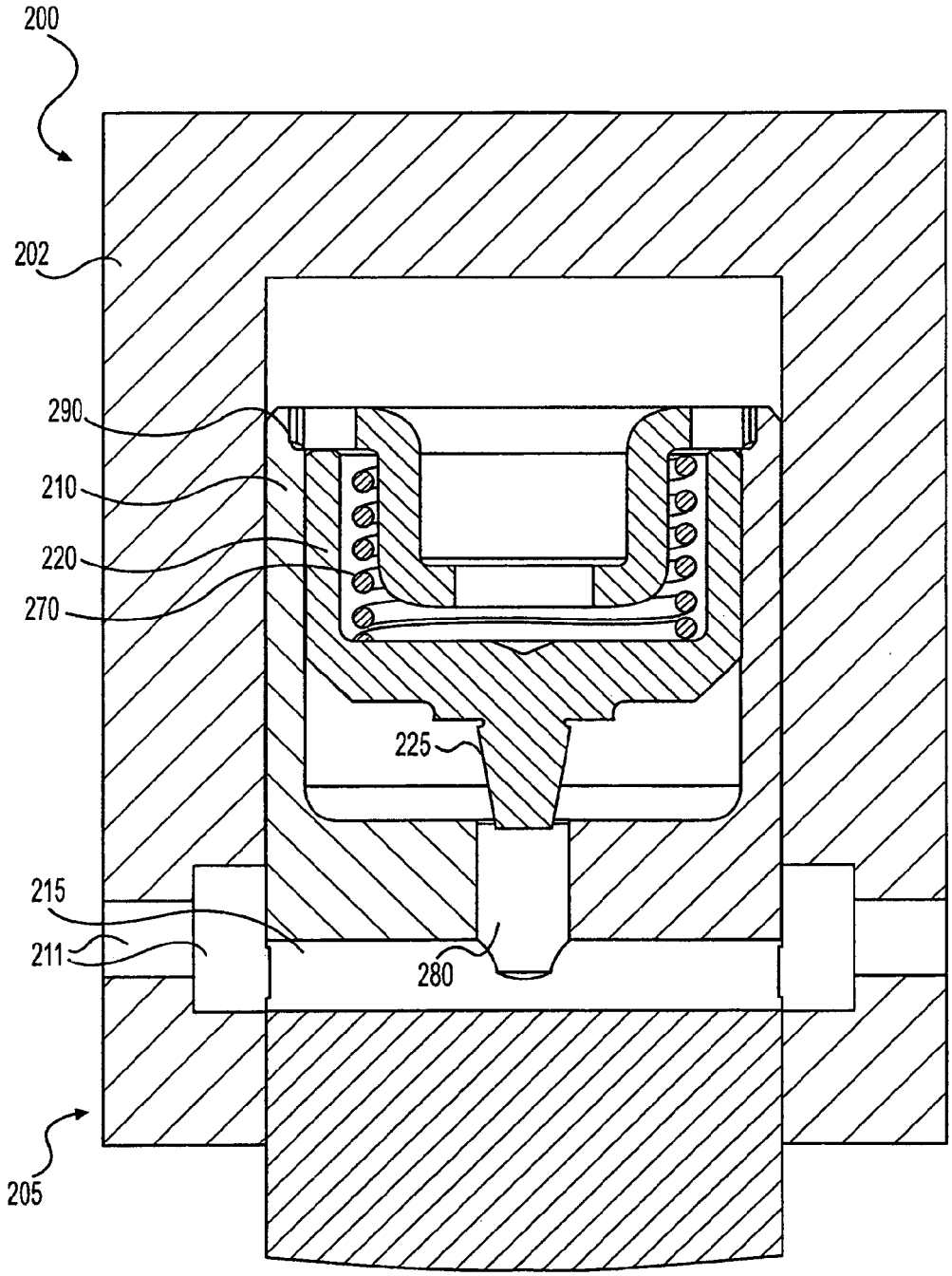
FIG. 6 is a cross-sectional view of the valve seating device in accordance with the third embodiment of the present invention during a second valve seating position.

A third embodiment of the valve seating device 200 is illustrated in FIGS. 5 and 6, in which like reference characters refer to like elements. The valve seating device 200 may be disposed in a housing 202 having a cylindrical bore formed therein. A lower housing portion 205 may include one or more side wall openings 211 for supplying hydraulic fluid to the valve seating device.

As shown in FIG. 5, a cylindrically shaped outer piston 210 may be slidably disposed in the housing 202. The outer piston 210 may include a hollow interior portion, an orifice 280 in a lower portion of the outer piston, a fluid slot 215 in a lower portion of the outer piston and below the orifice 280, and an upper end. The orifice 280 may permit hydraulic fluid to flow between the hollow interior portion of the outer piston 210 and the fluid slot 215. The outer piston 210 may include a lower end which contacts an engine valve 400 (shown in FIG. 1) or an engine valve bridge or any one of a number of intervening valve train elements 300 (shown in FIG. 1) which contact the engine valve. The lower end of the outer piston 210 permits transfer of engine valve closing force and valve seating resistance between the engine valve 400 and the valve seating device 200.

As shown in FIG. 5, a cylindrically-shaped catch piston 220 may be slidably disposed in the hollow interior portion of the outer piston 210. The catch piston 220 may include a cone-shaped extension 225 which extends from the bottom of the catch piston into the orifice 280 when the catch piston 220 is resting against the outer piston 210. The catch piston 220 may also include a hollow interior portion.

The cone-shaped extension 225 of the catch piston 220 may be selectively shaped to taper from its base to its lower terminus. The taper of the cone-shaped extension 225 may be selected to have substantially the same diameter of the orifice 280 at its base and a smaller diameter at its lower terminus. The cone-shaped extension 225 may taper linearly, progressively, or less than linearly from base to terminus depending upon the desired level of throttling of the flow of fluid through the orifice 280 during valve seating events.

As shown in FIG. 5, a cap 290 may be provided at the upper end of the outer piston 210. A catch piston spring 270 may be disposed in the interior portions of the catch piston 220. The catch piston spring 270 may bias the catch piston 220 and the cap 290 away from each other.

In order to slow the valve during valve seating events and to establish a full hydraulic link between the outer piston 210 and the catch piston 220, hydraulic fluid may be provided to the valve seating device 200. The hydraulic fluid may be provided to the valve seating device 200 from a source of engine lubricant (not shown) through the housing side wall openings 211 and into the fluid slot 215. As shown in FIG. 6, the incoming fluid may flow into the outer piston 210 and through the orifice 280. The fluid may fill the interior of the outer piston 210 without restriction, taking up the full lash between the outer piston 210 and the catch piston 220. Hydraulic fluid may also leak past the space between the catch piston 220 and the outer piston 210 to fill all interior spaces of the valve seating device 200, including the interior portions of the catch piston and the outer piston, as well as the space above the cap 290. As the interior spaces of the valve seating device 200 fill with hydraulic fluid, outer piston 210 is pushed downward to take up any lash space that may exist between the outer piston and the engine valve (or intervening valve train element). At the same time, the hydraulic pressure above and below the catch piston 210 may become equalized so that the catch piston 220 is biased downwards against the outer piston 210 by the catch spring 270 as shown in FIG. 5, thus stopping the flow of fluid through orifice 280.

The valve seating device 200 shown in FIGS. 5 and 6 may operate as follows. When valve seating control is desired, hydraulic fluid may be provided to the valve seating device 200 from a source of engine lubricant (not shown) through the housing side wall openings 211 into the fluid slot 215. Because the downward bias of the catch piston spring 270 is not great enough, the hydraulic fluid in the fluid slot 215 may push the catch piston 220 upward and flow past the cone-shaped extension 225 to fill the space between the outer piston 210 and the catch piston 220. Hydraulic fluid may also leak past the space between the catch piston 220 and the outer piston 210 to fill the interior portions of the catch piston and the outer piston, as well as the space above the cap 290. As a result, all interior spaces of the valve seating device 200 may be filled with hydraulic fluid.

The lower end of the outer piston 210 may follow the engine valve downward when it opens. As the outer piston 210 moves downward the catch piston 220 may move upward until both pistons are hydraulically locked as shown in FIG. 6.

As the engine valve closes, the outer piston 210 may be driven upward. The upward motion of the outer piston 210 may force the catch piston 220 downward, forcing hydraulic fluid in the space between the outer piston and the catch piston to flow past the cone-shaped extension 225. Further upward translation of the outer piston 210 may be resisted by the catch spring 270, as well as by the hydraulic fluid in the valve seating device 200. The cone-shaped extension 225 may progressively throttle fluid flowing out of the space between the outer piston 210 and the catch piston 220 through the orifice 280. The progressive throttling of the fluid flow permits the resistance to the upward translation of the pin 230 to progressively increase as the engine valve approaches its seat, thereby progressively reducing the upward velocity of the engine valve until it is seated. The cone-shaped extension 225 may be designed to progressively throttle this fluid flow during the last millimeter of engine valve travel before it is seated. In this manner, the cone-shaped extension may provide a variable flow area through the orifice 280. This may also permit the orifice 280 to have a greater diameter and may provide more rapid refill of the interior of the valve seating device 200 with hydraulic fluid for the next valve seating event. Hydraulic fluid that flows from the interior of the valve seating device 200 back into the fluid slot 215 may be absorbed into the relatively low pressure hydraulic fluid supply system (not shown) through the side wall openings 211.

Figure 7:
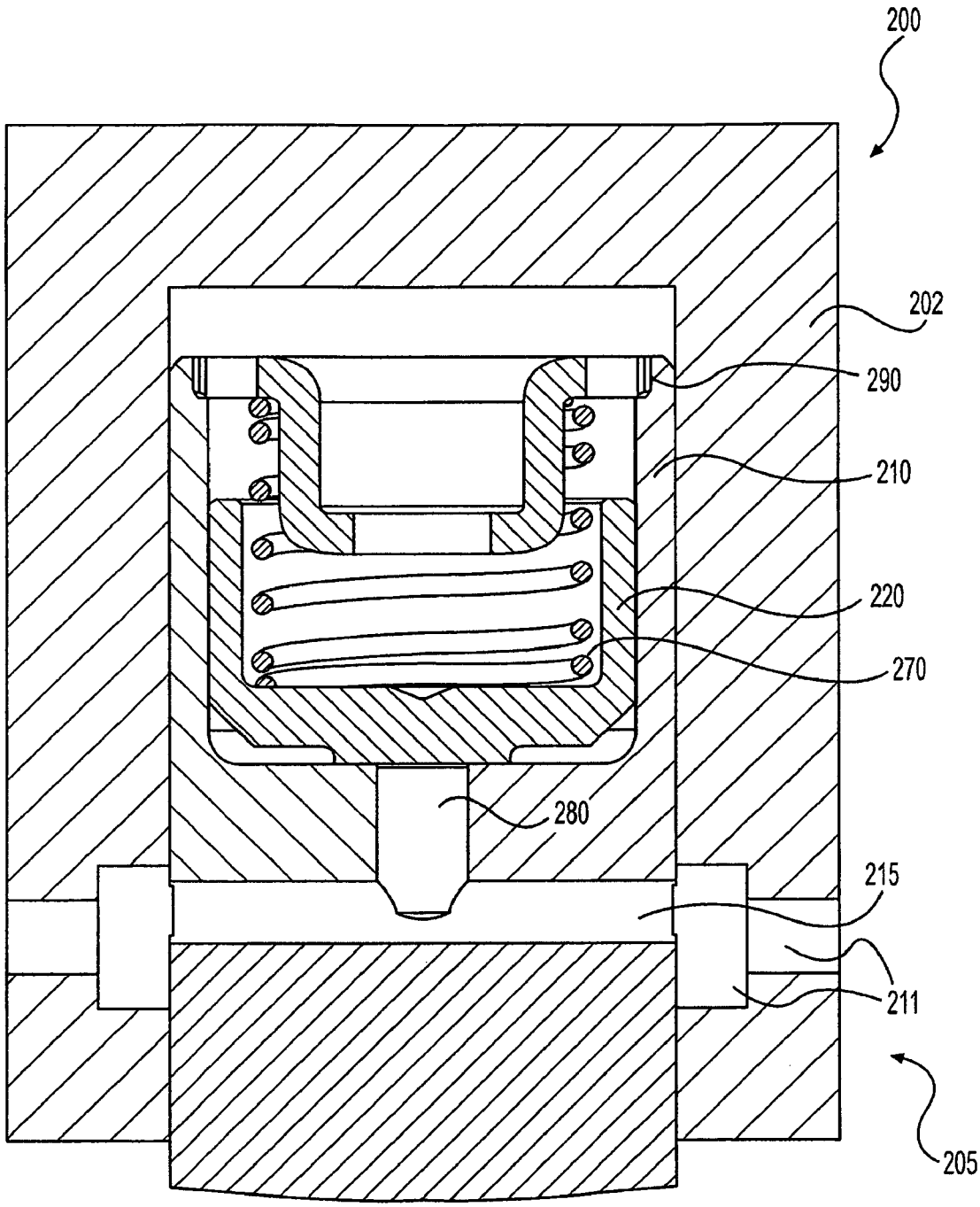
FIG. 7 is a cross-sectional view of a valve seating device in accordance with a fourth embodiment of the present invention.

A fourth embodiment of the valve seating device 200 is illustrated in FIG. 7 in which like reference characters refer to like elements. The valve seating device shown in FIG. 7 differs from that shown in FIGS. 5 and 6 in that the catch piston 220 does not have a cone-shaped extension 225. The upward translation of the outer piston 210 may be resisted by the catch spring 270, as well as by the hydraulic fluid in the valve seating device 200. The progressively throttling may occur by the flow of fluid out of the outer piston 210 and the catch piston 220 through the narrow hydraulic spaces between the outer piston 210 and the catch piston 220 and between the outer piston 210 and the housing 202.

Figure 4:
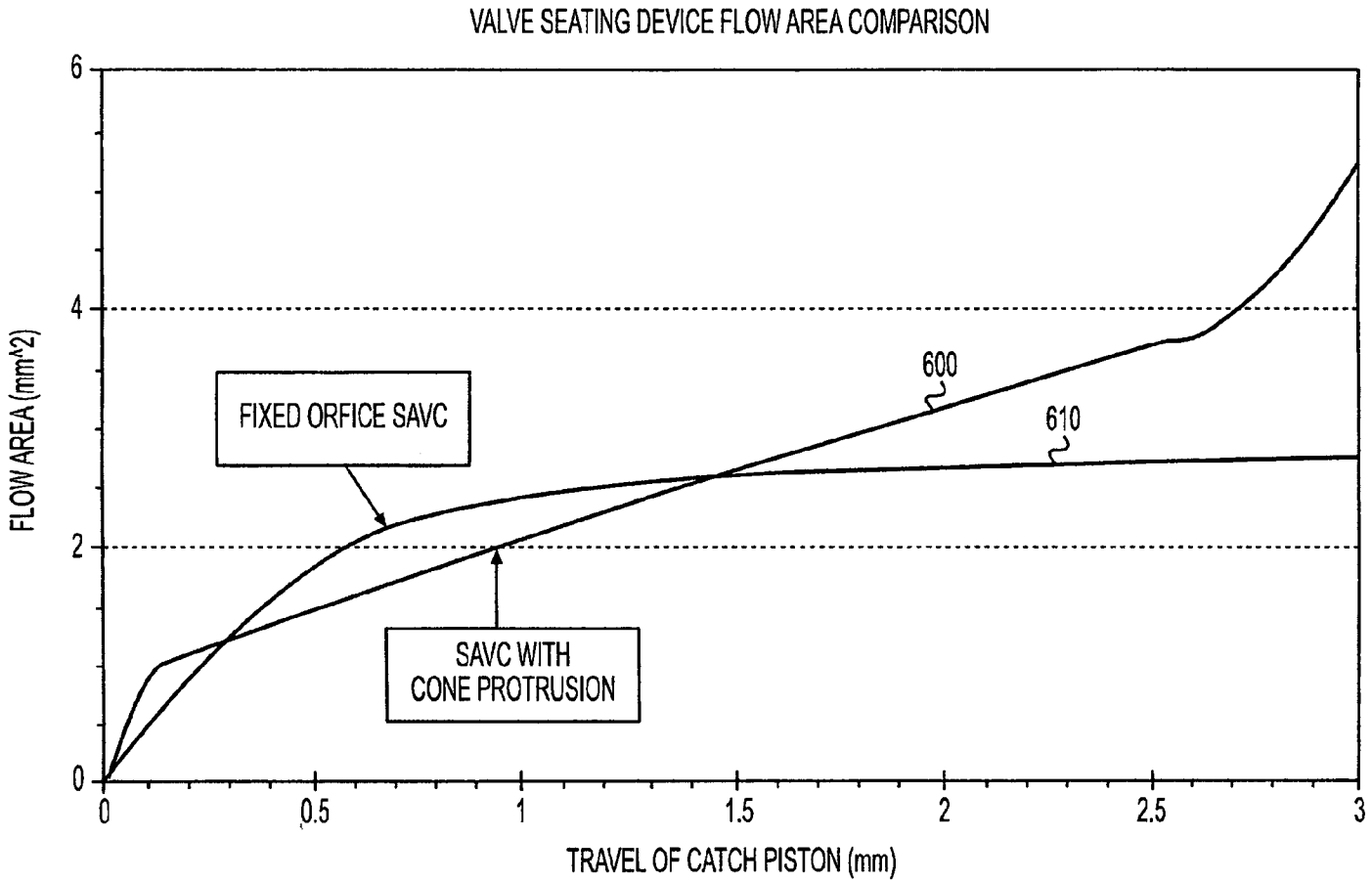
FIG. 4 is a graph of flow area versus valve seating device travel in accordance with an embodiment of the present invention.

FIG. 4 is a graph comparing the expected relative flow area to catch piston travel for a known valve seating device 610 to that of a valve seating device made in accordance with an embodiment of the invention 600. The graph shows that flow area may be initially greater (right portion of the graph) during the early fill and seating motions, and may progressively restrict at a greater rate as the valve approaches its seat (left portion of the graph) when using the valve seating device made in accordance with an embodiment of the present invention.

It will be apparent to those skilled in the art that various modifications and variations can be made in the construction, configuration, and/or operation of the present invention without departing from the scope or spirit of the invention. For example, where lost motion functionality is not required, it is contemplated that embodiments of the valve seating device 200 may be provided in a system without the lost motion system 100. Still further, it is appreciated that the valve seating device 200 may be provided at virtually any point in an engine valve train so long as it operates to seat the engine valve.

What is claimed is:

1. A valve seating device, comprising:

a housing having a bore, a bore side wall, and side wall openings;

an outer piston slidably disposed in the bore, the outer piston having an internal hydraulic passage, an internal chamber defined by an outer piston side wall, outer piston bottom wall, and an internal orifice connecting the internal hydraulic passage and the internal chamber;

a catch piston slidably disposed in the outer piston internal chamber, the catch piston having an extension extending from the catch piston; and the catch piston extension having a shoulder with a flat face adapted to seat against the outer piston bottom wall and a cone-shaped extension extending from the flat face into the outer piston internal orifice.

2. The valve seating device of claim 1 further comprising:

a cap contacting an upper portion of the outer piston; and a catch piston spring disposed between the catch piston and the cap.

3. The valve seating device of claim 1 wherein the cone-shaped extension is tapered linearly from a base portion to a terminus.

4. The valve seating device of claim 1 wherein the cone-shaped extension is tapered progressively from a base portion to a terminus.

5. The valve seating device of claim 1 wherein the cone-shaped extension is tapered to a lesser and lesser degree from a base portion to a terminus.

6. The valve seating device of claim 1 further comprising one or more check valves disposed between the internal hydraulic passage and the internal chamber of the outer piston.

7. The valve seating device of claim 1 wherein the flat face of the shoulder of the catch piston extension is adapted to seal the outer piston internal orifice when it sits on the outer piston bottom wall.

8. The valve seating device of claim 1 wherein the cone-shaped extension extends from the flat face of the shoulder of the catch piston extension into the entirety of the outer piston orifice.

9. A valve seating device, comprising:

a housing having a bore, a bore side wall, and side wall openings;

an outer piston slidably disposed in the bore, the outer piston having an internal hydraulic passage, an internal chamber defined by an outer piston side wall, outer piston bottom wall, and an internal orifice connecting the internal hydraulic passage and the internal chamber;

a catch piston slidably disposed in the outer piston, the catch piston having an extension extending from the catch piston, and the catch piston extension having a shoulder with a flat face adapted to seat against the outer piston bottom wall and a cone-shaped extension extending from a part of the flat face into the outer piston internal orifice;

a cap disposed at an upper portion of the outer piston; and a catch piston spring disposed between the catch piston and the cap.

10. The valve seating device of claim 9 wherein the flat face of the shoulder of the catch piston extension is adapted to seal the outer piston internal orifice when it sits on the outer piston bottom wall.

11. The valve seating device of claim 9 wherein the cone-shaped extension extends from a part of the flat face of the shoulder of the catch piston extension into the entirety of the outer piston orifice.

12. A valve seating device, comprising:

a housing having a bore, a bore side wall, and side wall openings;

an outer piston slidably disposed in the bore, said outer piston having an internal hydraulic passage, an internal chamber defined by an outer piston side wall, and an internal orifice connecting the internal hydraulic passage and the internal chamber;

a cylindrically shaped catch piston slidably disposed in the outer piston internal chamber, the catch piston having a hollow interior portion and the catch piston having an extension extending from the catch piston;

the catch piston extension having a shoulder with a flat face adapted to seat against the outer piston bottom wall and a cone-shaped extension extending from the flat face into the entirety of the outer piston internal orifice;

a cap disposed at an upper portion of the outer piston; and a catch piston spring disposed between the catch piston and the cap.

* * * * *